US006849159B1

(12) United States Patent
Ilvespää et al.

(10) Patent No.: US 6,849,159 B1
(45) Date of Patent: Feb. 1, 2005

(54) DEVICE AND METHOD IN THE TRANSFER OF THE PAPER BOARD WEB IN THE PAPER OR BOARD MACHINE

(75) Inventors: Heikki Ilvespää , Jyväskylä (FI); Juhani Vestola, Jyväskylä (FI); Kari Juppi, Palokka (FI); Antti Komulainen, Keuruu (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/424,636

(22) PCT Filed: May 28, 1998

(86) PCT No.: PCT/FI98/00446

§ 371 (c)(1),
(2), (4) Date: Nov. 29, 1999

(87) PCT Pub. No.: WO98/56983

PCT Pub. Date: Dec. 17, 1998

(30) Foreign Application Priority Data

May 30, 1997 (FI) ..... 972302

(51) Int. Cl.[7] ..... D21F 11/10

(52) U.S. Cl. ..... 162/205; 162/193; 162/207; 162/358.4; 162/359.1; 162/202; 162/255; 162/358.1

(58) Field of Search ..... 162/205, 207, 162/193, 359.1, 901, 202, 255, 358.1, 358.4, 290, 297, 209; 34/116, 117

(56) References Cited

U.S. PATENT DOCUMENTS 4,000,035 A * 12/1976 Schiel et al. ..... 162/290
4,483,745 A * 11/1984 Wicks et al. ..... 162/205
5,169,501 A * 12/1992 Meinecke ..... 162/359.1
5,298,124 A 3/1994 Eklund et al. ..... 162/306
5,397,438 A 3/1995 Nyberg et al. ..... 162/207
5,611,892 A * 3/1997 Karvinen et al. ..... 162/205

FOREIGN PATENT DOCUMENTS

FI 84088 6/1991 ..... D21F/5/04
WO 9714846 4/1997 ..... D21F/1/00

OTHER PUBLICATIONS

Copy of PCT International Search Report, Sep. 18, 1998.

* cited by examiner

*Primary Examiner*—Peter Chin
*Assistant Examiner*—Mark Halpern
(74) *Attorney, Agent, or Firm*—Steinberg & Raskin, P.C.

(57) ABSTRACT

The invention concerns an equipment and a method in the transfer of a paper/board web in a paper or board machine. In an embodiment of the invention, the dryer section comprises at least one group of drying cylinders in which, instead of a conventional wire draw, a transfer belt ($H_{100}$) is employed, to which the web (W) is affixed by effect of adhesion and which transfer belt is passed over drying cylinders ($K_1$, $K_2$, . . . ) and reversing rolls ($E_1$, $E_2$, . . . ) and further in said group ($R_I$) of drying cylinders in the dryer section. The invention also concerns a method in the transfer of the web (W) in the dryer section (K) of a paper/board machine. In an embodiment of the invention, the web (W) is passed, while meandering in loop shape and while adhering to the face of the transfer belt ($H_{100}$), from a drying cylinder ($K_1$) in the group ($R_I$) of drying cylinders in the dryer section (K) onto a reversing roll ($E_1$) and further from the reversing roll onto the next drying cylinder ($K_2$) and further in the group ($R_I$) of drying cylinders.

20 Claims, 12 Drawing Sheets

DEVICE AND METHOD IN THE TRANSFER OF THE PAPER BOARD WEB IN THE PAPER OR BOARD MACHINE

FIELD OF THE INVENTION

The invention concerns an equipment and a method in the transfer of a paper/board web in a paper or board machine.

BACKGROUND OF THE INVENTION

The running of the web in the initial end of the dryer section is often the most critical stage, because the percentage of moisture in the web is still considerably high and the risk of break of the web is then also higher than in the final end of the dryer section. In conventional dryer sections with single-wire draw, thus, the first drying group is, as a rule, the drying group that determines the speed of the whole machine. In the prior art, attempts have been made to minimize these problems of runnability by first shifting from twin-wire draw to single-wire draw, by developing various devices that stabilize the run of the web, such as, for example, UR blow boxes, and by substituting for the reversing cylinders in the single-wire draw by suction rolls, such as, for example, Vac rolls. Further, in order to provide a more efficient support, the vacuum levels in the suction rolls have been increased, which, of course, increases the consumption of energy in the paper machine. As is known from the prior art, attempts have also been made to reduce the problems of runnability in the initial end of the dryer section by, in the beginning of the dryer section, fitting a substantially horizontal wire draw on which the web is dried by blowing hot air against the web. One problem in this solution is the space taken by the impingement drying arrangements. In the present patent application, it is suggested that, at least in the first drying group, in stead of an ordinary drying wire, a so-called transfer belt is employed, which is such a belt element that transfers the web whose face is smooth and whose adhesion properties are good. The web adheres to the face of the transfer belt. Further, the transfer belt is impenetrable by air and water. When a transfer belt in accordance with the invention is used, no separate web support blowing or equivalent is needed, but tie transfer belt alone operates as an element that transfers and affixes the web. Owing to the belt, the running of the web is stable. Owing to said web affixing property, the web remains on the face of the transfer belt also on curved runs of the web. In a group of drying cylinders with single wire draw and provided with a transfer belt, it is, thus, not necessary to employ so-called suction rolls as reversing cylinders.

When the speeds of paper machines become higher, said problems of runnability, in particular in the beginning of the dryer section, are emphasized. With increasing running speeds, it has become necessary to avoid open draws of the web also between the press section and the dryer section. As is known from the prior art, it has been suggested that said draw is closed, among other things, by picking up the web directly from the face of a press roll by means of a suction roll onto a drying wire. Also, in a way known from the prior art, a transfer belt has been used in the press section, which belt does not receive water and does not wet the web and from which belt the web has been picked up as a closed draw onto the drying wire of a cylinder group or directly onto the face of the first cylinder. Said technique has not yet become very common. One potential problem is the transfer of the web from the transfer belt to the dryer section, and an embodiment of the present invention attempts to reduce this problem.

OBJECTS AND SUMMARY OF THE INVENTION

In view of avoiding the problems mentioned above, in the method in accordance with the present invention, the web is made to adhere to the outer face of a transfer belt substantially not receiving water in the press section, for example in its last press nip, and the web is passed as a closed draw into the dryer section.

Thus, the solution in accordance with the invention includes a transfer belt loop, which does substantially not receive water and whose outer face is capable of adhering to the paper web and which has been fitted to run as a continuous loop at least through the last press in the press section and further over drying cylinders. The transfer belt $H_{100}$ is favourably of the type described in the U.S. Pat. No. 5,298,124.

By means of the method and the concept of equipment in accordance with the present invention, it is possible to accomplish improved properties of smoothness of the faces of paper or board to be manufactured and more stable running of the web, which is partly based on the use of a transfer belt which has a relatively smooth face and which is applied and arranged in accordance with the present invention.

The invention is usable with further increasing running speeds in new machines, but it also offers an easy mode of improving the runnability in the initial part of the dryer section in existing paper machines. An existing wire is substituted for by a transfer belt in accordance with the invention.

BRIEF DESCRIPTION OF THE DRAWINGS

In the following, the invention will be described in detail with reference to some exemplifying embodiments of the invention illustrated in the figures in the accompanying drawings, the invention being by no means strictly confined to the details of said embodiments.

DETAILED DESCRIPTION OF THE INVENTION

Figure 1:
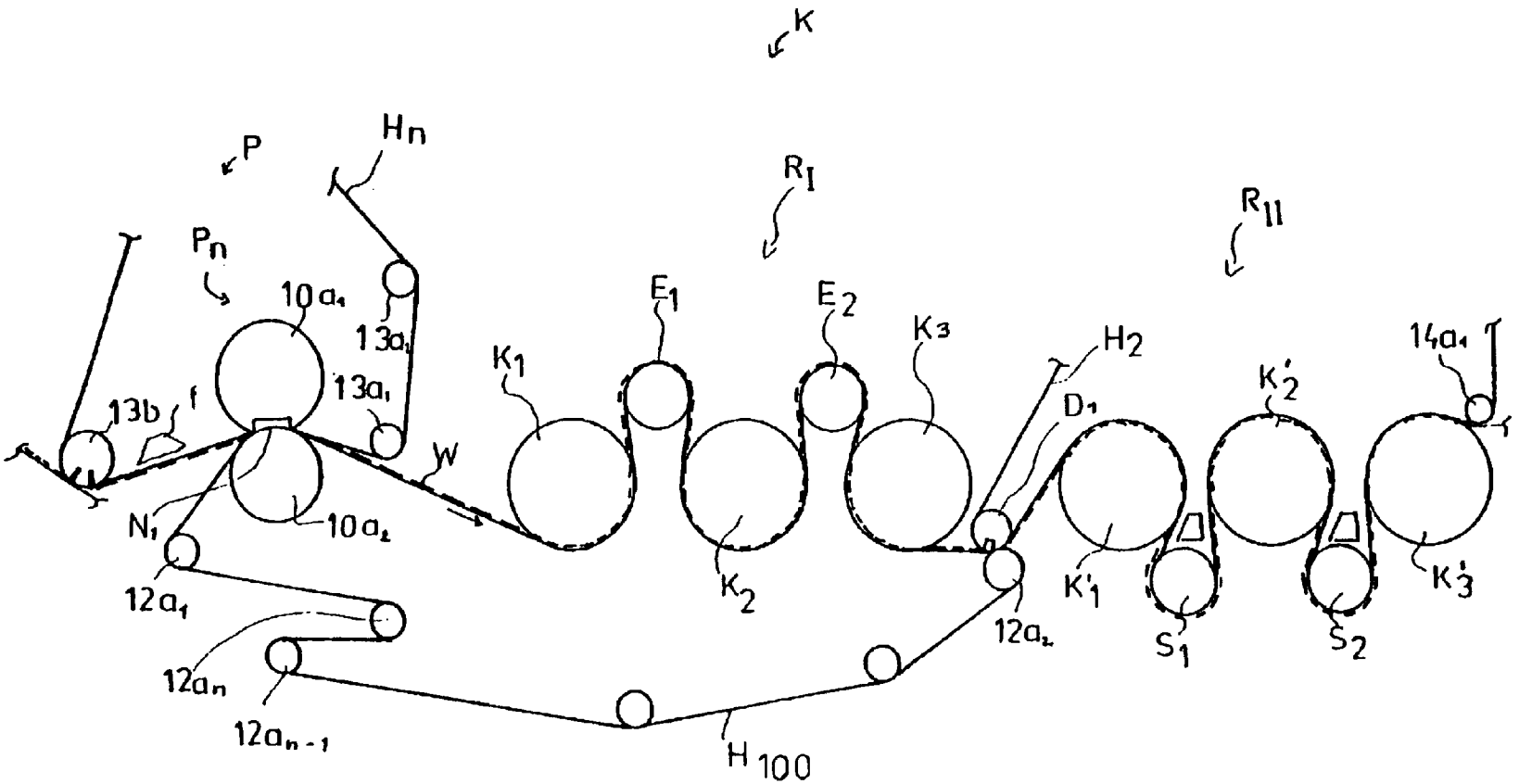
FIG. 1 shows a construction of a dryer section in accordance with the invention, which comprises a transfer belt draw in stead of a conventional single-wire draw, which transfer belt draw preferably extends to the press, i.e. runs through a press nip.

In the construction shown in FIG. 1, the single-wire draw has been substituted for by a transfer belt draw. Further, in the dryer section concept shown in FIG. 1, besides through the first group $R_I$ of drying cylinders in the dryer section K, the transfer belt $H_{100}$ also runs through the press section P. The transfer belt $H_{100}$ runs as a closed loop through the nip $N_1$ between the press rolls $\mathbf{10}a_1$,$\mathbf{10}a_2$ in the press $P_N$. In the solution in accordance with the invention, in the way shown in FIG. 1, the paper or board web W adheres, in the nip $N_1$ between the press rolls $\mathbf{10}a_1$ and $\mathbf{10}a_2$ in the press 10, to the transfer belt $H_{100}$ passed through the press nip $N_1$ and runs on the face of the transfer belt into the dryer section K to its first group $R_I$ of drying cylinders. Thus, the transfer belt $H_{100}$ has been passed at least through the last press nip $N_1$ in the press $P_N$ in the press section P. The web is passed to the press $P_N$ by means of the suction of the pick-up roll 13*b* so that the web is first transferred onto a transfer felt $H_N$ and kept along with the face of the felt by means of the holding suction produced by a blow box f. Thus, the transfer felt $H_N$ has been passed through the nip $N_1$ and guided by the felt guide rolls $\mathbf{13}a_1$,$\mathbf{13}a_2$ . . . . The press $P_N$ is preferably an extended-nip press, whose upper roil $\mathbf{10}a_1$, as is shown in FIG. 1, is a so-called extended-nip roll and comprises a resilient belt mantle of an extended-nip roll. The upper extended-nip roll $\mathbf{10}a_1$ in the extended nip comprises a loading shoe, which is pressed towards the backup roll, in which connection the resilient belt mantle complies with the face form determined by the loading shoe. From the drying group $R_I$ the web W is transferred to the second drying group $R_{II}$, which is conventional, i.e. comprises a conventional single-wire draw with a conventional wire $H_2$. The wire $H_2$ is guided as a closed loop over the wire guide rolls $\mathbf{14}a_1$, $\mathbf{14}a_2$. It should, however, be emphasized in this connection that the invention is also usable in connection with other prior-art press solutions, besides in connection with an extended-nip press. The press may advantageously also consist of more than one dewatering press nips.

A significant drawback of the press felts that have been employed in prior-art press sections has been an effect of rewetting the web and a tendency of contamination. A transfer belt $H_{100}$ in accordance with the invention does substantially not receive water, is impenetrable by air, smooth, and its outer face is capable of adhering to the paper web. In such a case, the paper web can be made to adhere to the outer face of the transfer belt loop without rewetting of the web. On the transfer belt the web (paper or board web) can be passed as a closed and supported draw from the press to the dryer section K to the first drying group $R_I$ in the dryer section and from said group into the conventional group $R_{II}$ of drying cylinders provided with single-wire draw, which group comprises conventional suction rolls $S_1$,$S_2$ . . . of the VacRoll type.

From the nip $N_1$ formed by the press rolls $\mathbf{10}a_1$ and $\mathbf{10}a_2$, which nip is preferably an extended nip, the web is carried on the top face of the transfer belt $H_{100}$ onto the first drying cylinder $K_1$ in the first group $R_I$ of drying cylinders in the preliminary dryer section, i.e. in the dryer section K, which cylinder $K_1$ is a steam-heated drying cylinder. The web W runs further along the face of the drying cylinder $K_1$ between the transfer belt $H_{100}$ and the face of the drying cylinder $K_1$ further onto an ordinary reversing roll $E_1$ and remains in contact with the face of the transfer belt $H_{100}$ also in connection with the reversing roll $E_1$, which is an ordinary, non-heated roll construction. The transfer belt $H_{100}$ has been passed, besides over the drying cylinders $K_1$,$K_2$ . . . and over the reversing rolls $E_1$,$E_2$ and through the nip $N_1$, also over the transfer belt guide rolls $\mathbf{12}a_1$,$\mathbf{12}a_2$ . . . $\mathbf{12}a_N$. The web W runs meandering in loop shape in the group $R_I$ of drying cylinders in the dryer section, i.e. from the reversing roll $E_1$ further onto the second heated drying cylinder $K_2$ in the group $R_I$ and further in the group $R_{II}$ of drying cylinders. Thus, in the drying group $R_I$, the reversing rolls $E_1,E_2 \ldots E_n$ can be ordinary smooth-faced rolls. The rolls may also have grooved faces. They do not need inside suction or perforations, by whose means, in a conventional dryer section provided with single-wire draw, the web W is affixed at the suction cylinders to the wire face. The properties of the transfer belt $H_{100}$ are such that the web W remains in contact with the face of the transfer belt also in the loop-shaped meandering web run formed by conventional reversing rolls $E_1,E_2 \ldots$ not provided with suction. Out of connection with the drying cylinder $K_3$, the web W is transferred further onto the transfer suction roll $D_1$ in the second drying group $R_{II}$. Being transferred by means of the suction of the transfer suction roll $D_1$, the web W is separated from the transfer belt $H_{100}$ and is transferred further, out of connection with the face of the transfer belt $H_{100}$, into connection with the wire $H_2$ in the second group $R_I$, of drying cylinders in the dryer section K and further in said conventional group $R_{II}$, of drying cylinders.

In the beginning of the dryer section, the strength of the web W is lowest, because the water content in the web is still high. Thus, as a rule, the beginning of the dryer section has determined the maximal speed at which it has been possible to run the paper/board machine. Thus, as a rule, the first drying group $R_I$ has determined the maximal speed of the dryer section and, thus, also of the whole paper/board machine. When a transfer belt $H_{100}$ is used in the fist group $R_I$ of drying cylinders in the dryer section K, the speed of the whole paper/board machine can be increased to a significant extent. When a transfer belt $H_{100}$ is employed in stead of a conventional wire, it is possible to stabilize and to speed up the draw of the web to a considerable extent in the initial end of the dryer section. When a transfer belt $H_{100}$ is used, the run of the web W is stable and steady, and there is no risk of web break. The web W is transferred as a closed draw from the press into the dryer section into its group $R_I$ of drying cylinders and from said group into the second group $R_{II}$. There are no open web draws in the first group $R_I$ of drying cylinders in accordance with the invention in the dryer section K.

As is shown in FIG. 1, the web is passed from the preliminary dryer section in accordance with the invention, i.e. from the first drying group $R_I$ in accordance with the invention, to the second group $R_{II}$ of drying cylinders in the dryer section, which group is a conventional group of drying cylinders provided with single-wire draw, in which the wire has been fitted to run over conventional suction rolls $S_1,S_2 \ldots$ of the VacRoll type. The suction rolls $S_1,S_2 \ldots$ comprise a perforation passing through the roll mantle and opening into the grooves placed on the mantle face of the roll, on one hand, and into the interior of the roll, on the other hand, and a vacuum is applied to the roll interior. In such a case, a suction and holding force can be applied to the grooves provided in the circumferential direction on the face of the roll mantle and, further, to the web W that is passed outside. The wire is a conventional fabric permeable to air and used in single-wire draw. Even though, in FIG. 1, the group $R_{II}$ is a normal group with single-wire draw, in some cases, in particular in modernizations by whose means attempts are made expressly to eliminate problems of runnability in the beginning of the dryer section, in accordance with the present invention, the group $R_{II}$ may also be a drying group of a different type, for example a Uno-Run group or even a group with twin-wire draw.

In traditional cylinder drying, in the first group, just very little evaporation of water present in the web takes place through the wire. This is why, employment of a belt impenetrable by air and water in compliance with the present invention does not reduce the drying efficiency to a substantial extent. On the contrary, as the web follows the belt reliably, the temperature of the cylinders can be raised without a risk that the web might follow the cylinder face. If it is desirable to increase the drying capacity further, it is possible to use an arrangement in accordance with FIG. 2.

Figure 2:
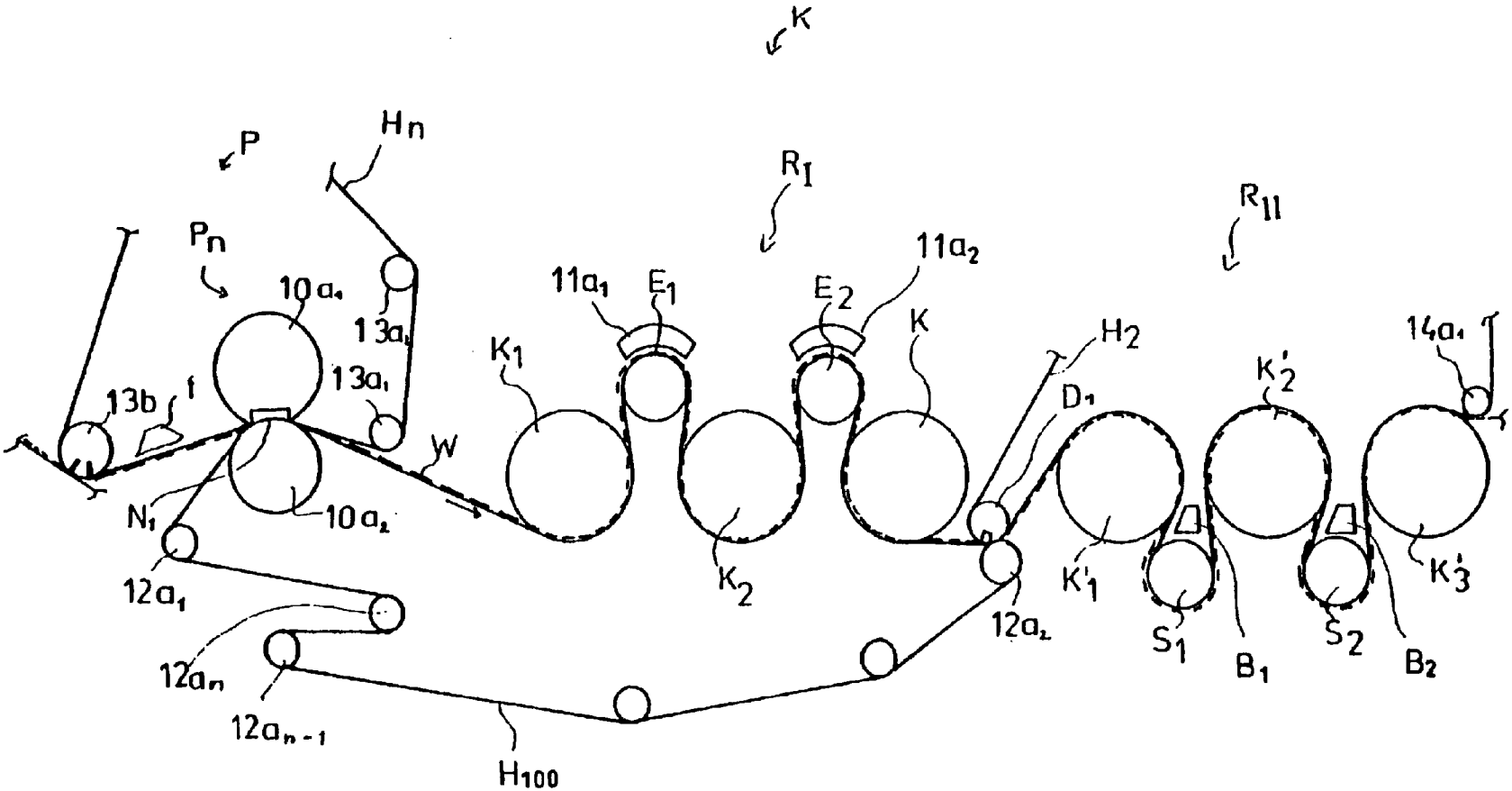
FIG. 2 shows a dryer section provided with a transfer belt draw, comprising impingement drying units in connection with drying cylinders and reversing rolls, through which units a drying medium is supplied to increase the drying capacity.

In view of increasing the drying capacity, the group $R_I$ of drying cylinders in the dryer section shown in FIG. 2 is additionally provided with impingement drying boxes 11$a_1$, 11$a_2 \ldots$ placed in connection with the reversing cylinders $E_1,E_2 \ldots$, through which boxes hot air/hot gas/hot steam is blown into connection with the web W in order to increase the drying capacity. The construction of the dryer section shown in FIG. 2 is in other respects similar to the construction of the dryer section shown in FIG. 1. In a solution of equipment in accordance with the invention, the impingement drying units can be placed either exclusively in connection with steam-heated drying cylinders or, as is shown in FIG. 2, also in connection with the reversing cylinders $E_1,E_2 \ldots$. In principle, similar impingement drying can also be arranged in connection with the drying cylinders $K_1,K_2 \ldots$, but its capacity remains low because of the impenetrable belt.

Figure 3A:
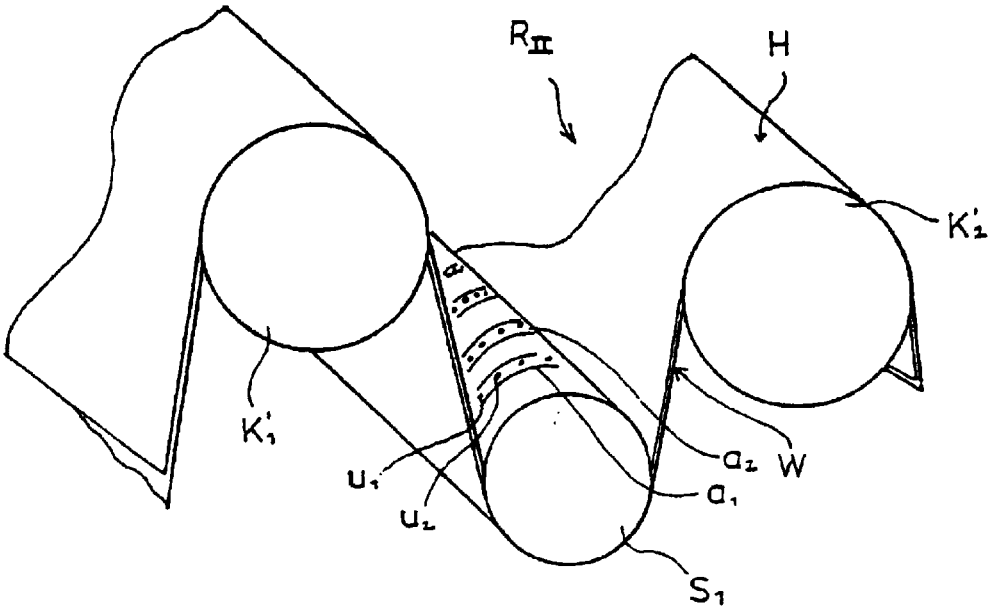
FIG. 3A shows a single wire draw arrangement which is used in a dryer section concept in accordance with the invention in its second group $R_{II}$ of drying cylinders.

FIG. 3A shows a single-wire draw which is employed in the group $R_{II}$ of dryng cylinders, i.e. the second group of drying cinders. An ordinary drying wire $H_2$ has been passed from the drying cylinder $K_1'$ onto the suction roll $S_1$ onto the second drying cylinder $K_2'$ and further in the group $R_{II}$ of drying cylinders. As shown in the figure, the suction cylinder $S_1$ comprises grooves $u_1$, $u_2$ on its face, in which grooves the holes $a_1$, $a_2$ passing through the mantle S' of the suction cylinder terminate. A vacuum is applied to the interior of the suction cylinder, by whose means a circumferential holding force can be applied to the web W. In the way shown in FIGS. 1 and 2, blow boxes $B_1$ and $B_2$ or equivalent apparatuses that stabilize the running of the web can also be fitted in the pockets formed by the cylinders and by the suction roll.

The dryer section concept in accordance with the invention can comprise a number of groups $R_{II},R_{III},R_{IV} \ldots$ drying cylinders, which groups are, after the first group of drying cylinders, ordinary groups of drying cylinders provided with single-wire draw. A transfer belt can also be employed in other groups of drying cylinders besides in the first group of drying cylinders.

Figure 3B:
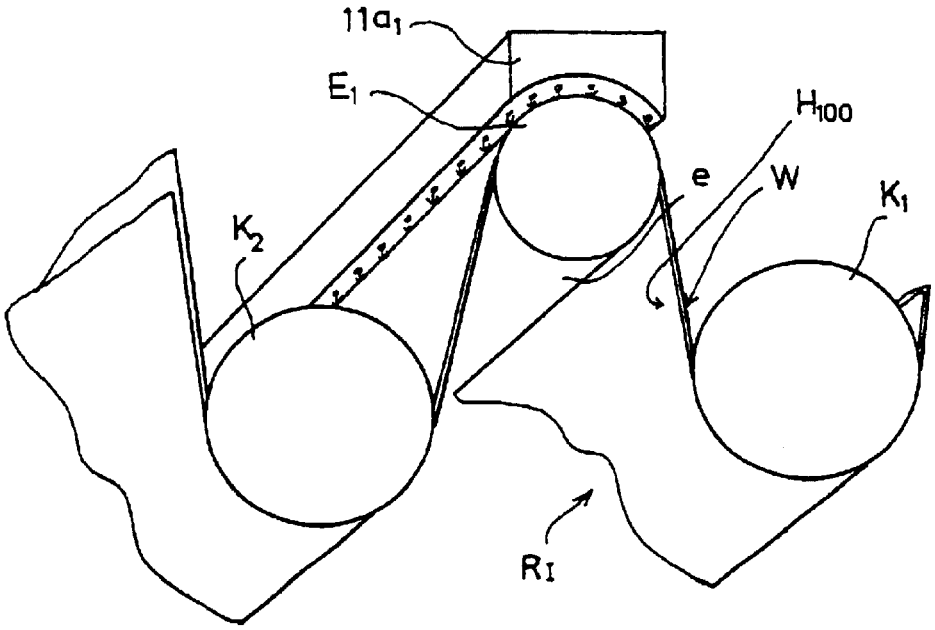
FIG. 3B shows a transfer belt draw in accordance with the invention employed in the first group $R_I$ of drying cylinders. The embodiment shown in FIG. 3B corresponds to FIG. 2, in which impingement drying units have been fitted in connection with the drying cylinders and with the reversing rolls.

FIG. 3B is an axonometric illustration of a group $R_I$ as shown in FIG. 2, wherein both the drying cylinders and the smooth-faced reversing cylinders are provided with impingement drying units 11$a_1$,11$a_2 \ldots$, through which a heat transfer medium, preferably steam or hot air, is passed into connection with the web W. As is shown in the figure, the reversing rolls $E_1,E_2 \ldots$ are smooth-fed reversing rolls. The transfer belt $H_{100}$ has been passed over the smooth, non-perforated roll faces e of the reversing rolls $E_1,E_2 \ldots$.

In the following FIGS. 4 to 8, different modes of transfer of the web to the dryer section K and from the first group of drying cylinders in the dryer section to the second group of drying cylinders will be illustrated. However, it is an essential feature of all of the embodiments to be described in the following that at least the group $R_I$ of drying cylinders is a drying group provided with a transfer belt $H_{100}$ similar to what has been described above in relation to FIG. 1.

Figure 4:
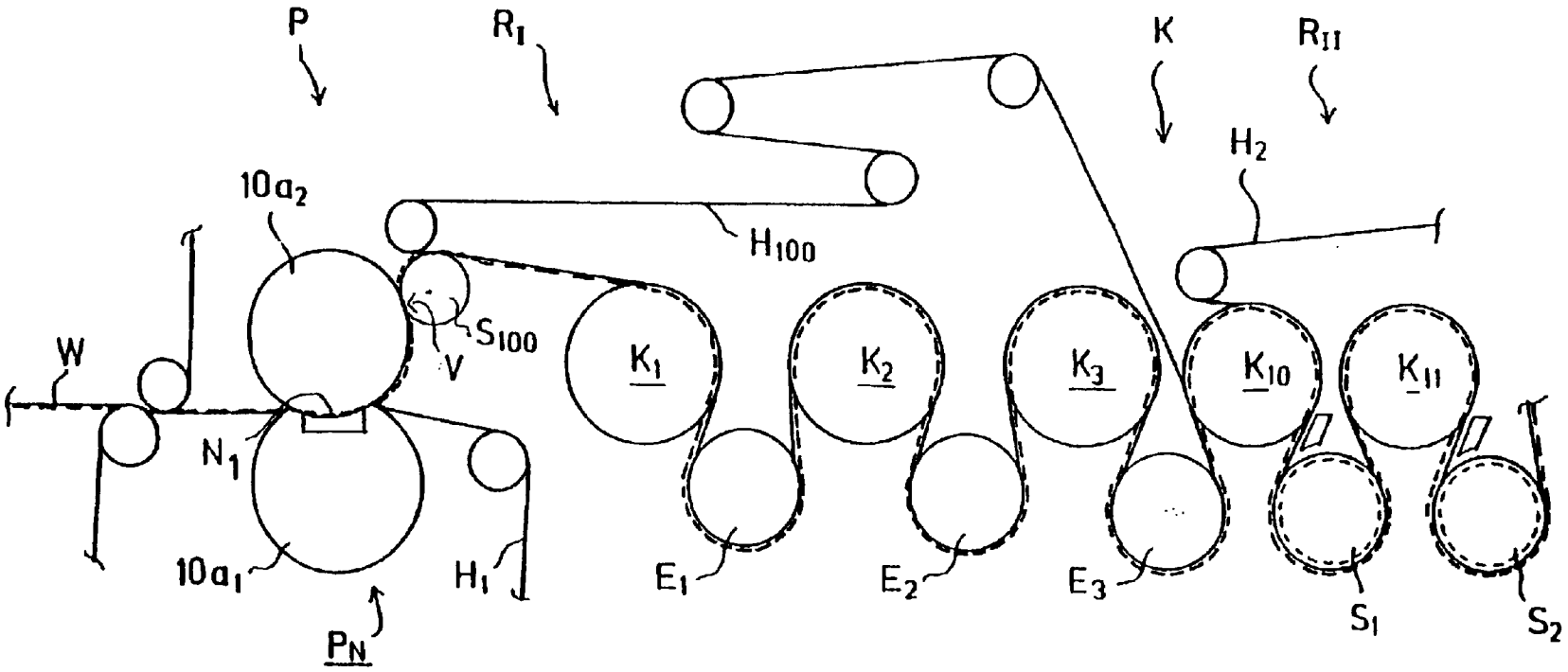
FIG. 4 shows an embodiment of the invention in which the web W is passed out of connection with the face of the backup roll of the extended-nip roll in an extended-nip press by means of an adhesion nip onto a transfer roll and further into connection with a transfer belt in accordance with the invention in the group of drying cylinders.

FIG. 4 shows an embodiment of the invention in which, similarly to the embodiment shown in FIG. 1, the group $R_I$ of drying cylinders in the dryer section K consists of drying cylinders $K_1$,$K_2$,$K_3$ and reversing cylinders $E_1$,$E_2$ and $E_3$. As is the case in the embodiment shown in FIG. 1, the drying cylinders $K_1$,$K_2$,$K_3$ are steam-heated smooth-faced drying cylinders, and the reversing cylinders $E_1$,$E_2$ . . . are conventional smooth-faced rolls. In the embodiment shown in the figure, between the drying groups $R_I$ and $R_{II}$, there is a smooth-faced roll $K_{10}$, which may also be a cylinder, such as a drying cylinder. In accordance with the invention, the group $R_I$ includes a transfer belt $H_{100}$, and, as is shown in the figure, the web W is transferred, meandering in loop shape, along with the transfer belt $H_{100}$, to which the web adheres by means of adhesion, further in the group of drying cylinders. The web is transferred into the group $R_I$ of drying cylinders from the press $P_N$ out of connection with the press rolls 10$a_1$ and 10$a_2$, which are preferably rolls in an extended-nip press. As is shown in the figure, the web W is transferred further, adhering to the smooth face of the upper backup roll 10$a_2$ of the smooth-faced extended-nip roll 10$a_1$, by means of an adhesion nip V, onto the upper transfer roll $S_{100}$, for example a suction roll, and from its connection into connection with the transfer belt $H_{100}$, to whose face the web W adheres. From the group $R_I$ the web is transferred into connection with the cylinder or smooth-faced roll $K_{10}$ and further into connection with the second drying group $R_{II}$, between the wire $H_2$ and the cylinder $K_{10}$ and further in the group $R_{II}$. The group $R_{II}$ can be a conventional group of drying cylinders with single-wire draw, in which, between the drying cylinders, there are VacRoll rolls $S_1$,$S_2$ . . . , as is the case also in the embodiment shown in FIG. 1. In this embodiment, the adhesion nip V may also operate as a scaled equalizing press, by whose means substantially the same smoothness is achieved for both faces of the web.

Figure 5:
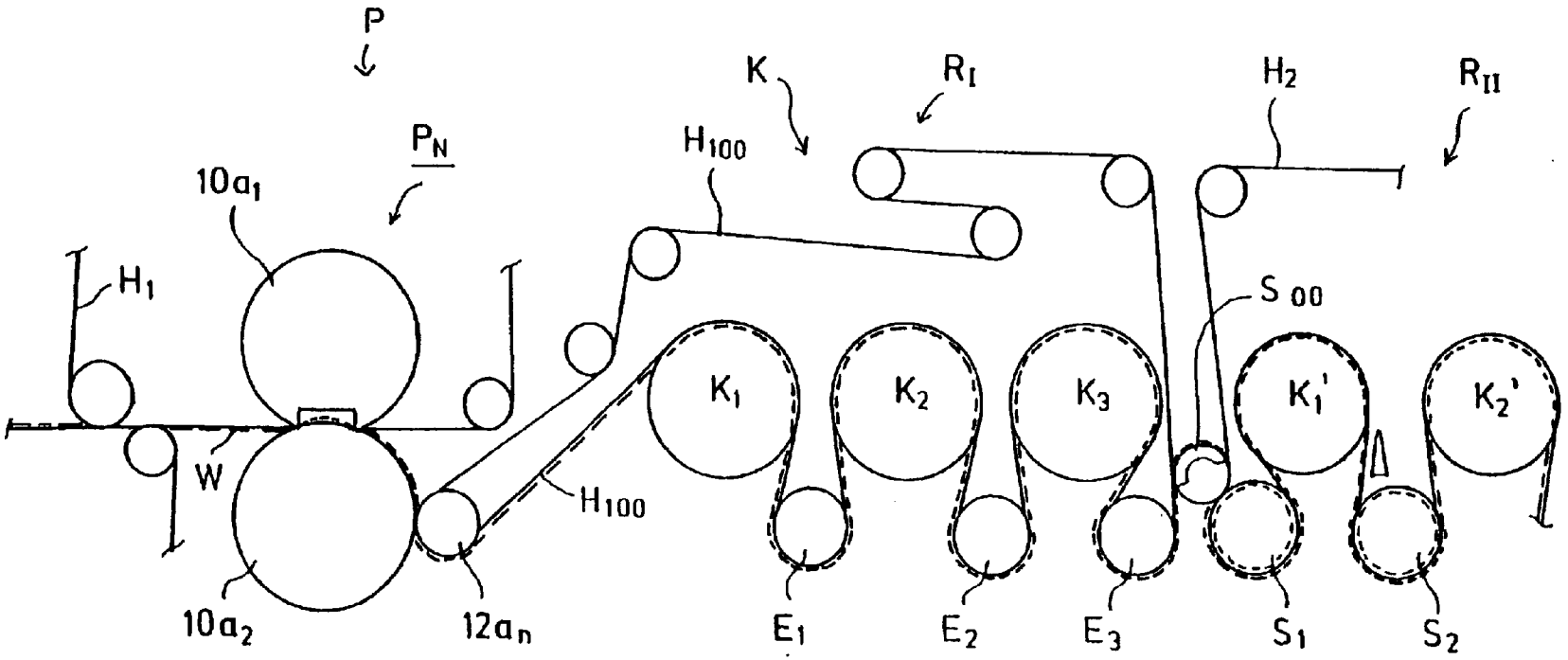
FIG. 5 shows an embodiment of the invention in which the web is passed from the face of the backup roll of an extended-nip roll directly into connection with a transfer belt.

FIG. 5 shows an embodiment of the invention in which the group $R_I$ of drying cylinders in the dryer section comprises a transfer belt $H_{100}$, as is the case in the preceding embodiments, but in which solution the web W is picked up into connection with the transfer belt $H_{100}$ out of connection with the press P, preferably out of connection with the backup roll 10$a_2$ of the extended-nip roll 10$a_1$ of an extended-nip press. After the nip $N_1$ in the press $P_N$ the web W moves a certain distance on the face of the backup roll 10$a_2$ of the press $P_N$, which roll is preferably a smooth-faced roll, and reaches contact with the transfer belt $H_{100}$, which has been brought into connection with said roll face, and adheres to the belt. In the embodiment of the figure, the guide roll 12$a_n$ has been fitted in such a way in connection with the lower roll 10$a_2$ of the press $P_N$ that the roll 12$a_n$, presses the transfer belt $H_{100}$ into contact with the lower roll 10$a_2$ of the press $P_N$. Thus, as is shown in the figure, the web W is transferred along with the transfer belt $H_{100}$, meandering in loop shape, over the drying cylinders $K_1$,$K_2$ . . . and the conventional smooth-faced reversing rolls $E_1$,$E_2$ . . . , in the same way as in the embodiment shown in FIG. 1, in the group $R_I$ onto the transfer suction roll $S_{100}$, which is placed between the groups $R_I$ and $R_{II}$ and which may comprise a wire sock on its face, in which connection a suction effect is applied to the web W in the position between the groups. In this way the web is transferred from the group $R_I$ to the group $R_{II}$, which may be a conventional group of drying cylinders with single-wire draw which includes Vac rolls $S_1$,$S_2$ . . . .

Figure 6A:
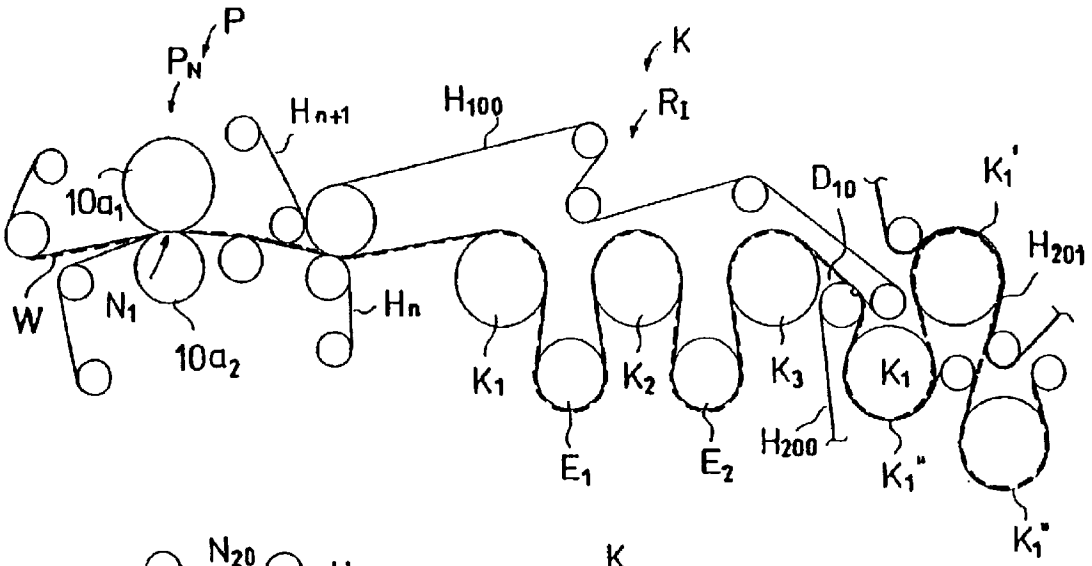
FIG. 6A shows an embodiment of the invention in which the web is passed into the first group of drying cylinders in the dryer section from the face of a press felt.

FIG. 6A shows an embodiment of the invention in which the web W is passed from the press P to the dryer section K into its first group $R_I$ of drying cylinders, which comprises a transfer belt $H_{100}$ as described above. In the embodiment of FIG. 6A, the web W is passed, while adhering to the transfer belt $H_{100}$ from the dying cylinder $K_1$ onto the smooth-faced reversing roll $E_1$ and further onto the drying cylinder $K_2$ placed in a different position of height, and further in the group of drying cylinders. Thus, the web is kept in contact with the face of the transfer belt $H_{100}$ constantly while the web adheres to the transfer belt by means of adhesion. Thus, Vac Rolls or equivalent are not needed, and blow boxes and equivalent are likewise not needed. From the press $P_N$ out of the nip $N_1$, the web W is passed in between the press felts $H_N$ and $H_{N+1}$. The web W is transferred from the felt $H_N$ onto the transfer belt $H_{100}$ of the group $R_I$, as is the case in the embodiment shown in FIG. 1, and from the group $R_I$ into the group $R_{II}$, which group $R_{II}$ can be, as is shown in the figure, for example, a twin-wire group comprising the wires $H_{200}$,$H_{201}$. Thus, from the group $R_I$ of drying cylinders the web is transferred, for example, into a conventional twin-wire group $R_2$ by means of a transfer suction roll $D_{10}$. Thus, the group $R_{II}$ of drying cylinders comprises conventional wires $H_{200}$,$H_{201}$, and drying cylinders $K_1'$,$K_1''$ and $K_2'$,$K_2'$ . . . .

Figure 6B:
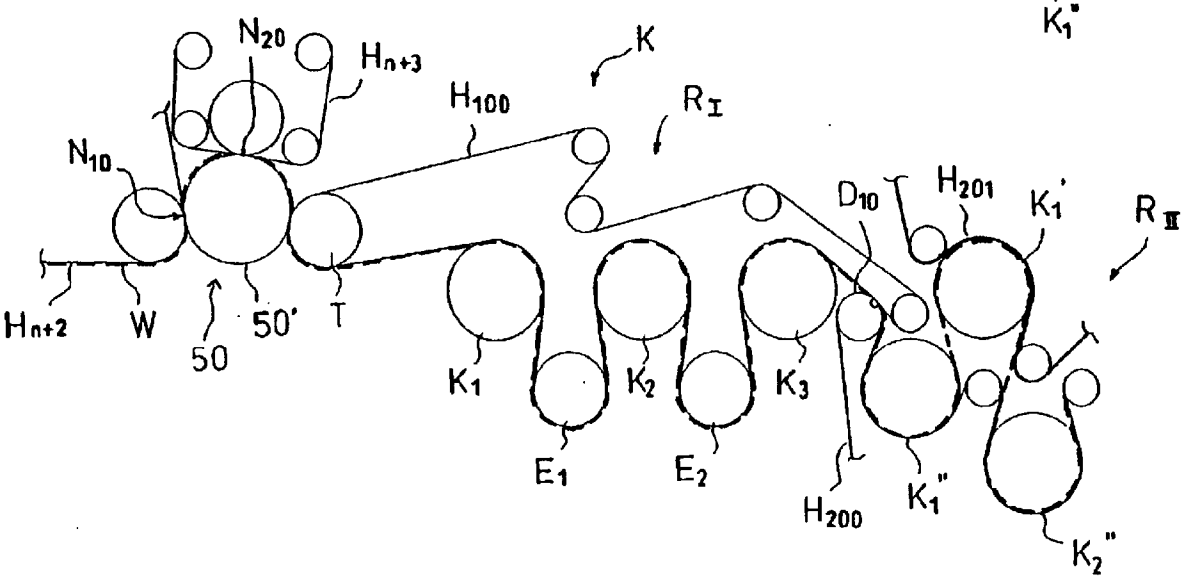
FIG. 6B shows an embodiment of the invention in which the web is passed into a group of drying cylinders in the dryer section from the face of a centre roll in the press by bringing the transfer belt into contact with the face of the centre roll in the press.

FIG. 6B shows an embodiment in which the web is transferred into the first group $R_I$ of drying cylinders in the dryer section K out of connection with the centre roll 50 of the press section P. As is shown in the figure, the web W is brought through the nip $N_{10}$ into connection with the centre roll 50 and transferred on the face of the centre roll into the second press nip $N_{20}$ and further, along the face 50' of the centre roll 50, through the press nip $N_2$ and further from the face 50' of the centre roll 50 into connection with the transfer belt $H_{100}$ of the group $R_I$, which transfer belt $H_{100}$ has been brought into contact with the face of the centre roll 50 by means of the roll T. As is shown in the figure, the group $R_{II}$ may be, for example, a group with twin-wire draw or, as is shown in FIG. 1, an ordinary group with single-wire draw. The group $R_I$ is of the same sort as the group $R_I$ in FIG. 1. The group $R_{II}$, is similar to that shown in the embodiment of FIG. 6A. It is obvious that the group can also be an ordinary, group of drying cylinders with single-wire draw. The felt draws in the press P have been denoted with $H_{n+2}$ and $H_{n+3}$.

Figure 7A:
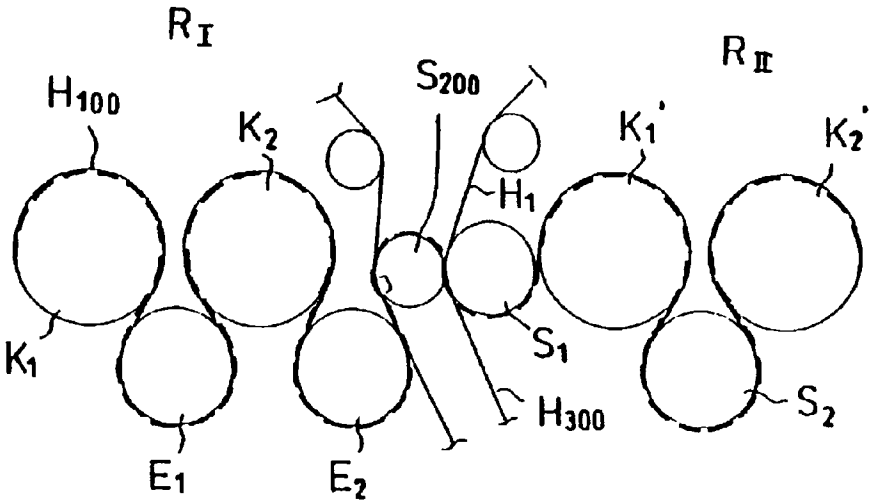
FIG. 7A shows the transfer of the web from the group $R_I$ of drying cylinders into the following group $R_{II}$ of drying cylinders by, between the groups, employing a separate transfer suction roll and a transfer fabric.

FIG. 7A shows a separate transfer fabric loop $H_{300}$, which is placed between the groups $R_I$ and $R_{II}$, and which has been passed over the suction roll $S_{200}$, which suction roll $S_{200}$ is placed between the groups $R_I$,$R_{II}$. The web W is transferred out of connection with the transfer belt $H_{100}$ of the group $R_I$ into connection with the transfer wire $H_3$ and further into the second drying group $R_{II}$. In the embodiment shown in the figure, the group $R_I$ comprises the transfer belt $H_{100}$, the smooth-faced reversing cylinders $E_1$ and $E_2$, and the drying cylinders $K_1$ ,$K_2$ . . . . As is shown in the embodiment shown in FIG. 1, the web runs, adhering to the transfer belt $H_{100}$, up to the end of the group $R_I$, where the web W is separated from the face of the transfer belt $H_{100}$ by means of the transfer wire $H_3$ and the transfer suction roll $S_{200}$, the web being transferred along with the transfer wire $H_3$ into the second group $R_{II}$ of drying cylinders, which may be a conventional group with single-wire draw, the web being brought first into vicinity of the transfer suction roll $S_1$ in said group, and being transferred further in a conventional group $R_{II}$, of drying cylinders provided with single-wire draw $H_1$.

Figure 7B:
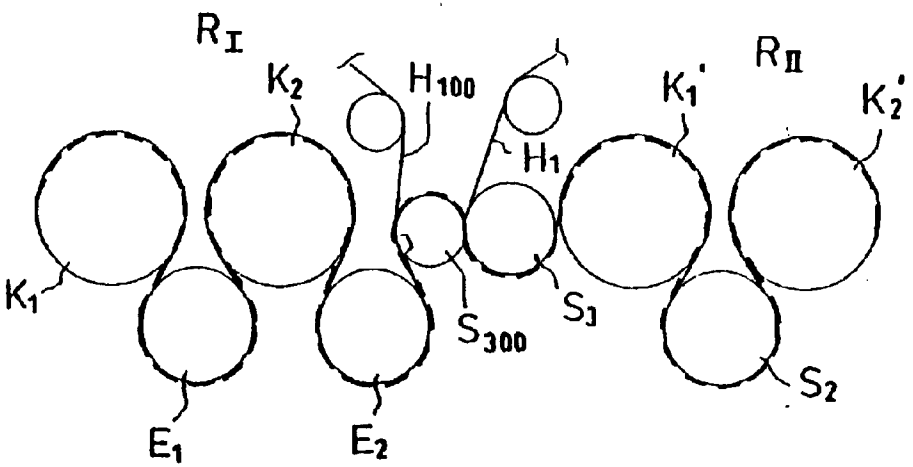
FIG. 7B shows an embodiment of the invention in which exclusively a transfer suction roll is employed between the groups $R_I$ and $R_{II}$ of drying cylinders.

FIG. 7B shows an embodiment which is in the other respects similar to that shown in FIG. 7A, but in which there is no separate loop of transfer wire $H_3$ and in which the web is picked up exclusively by means of the transfer suction roll $S_{300}$ from the transfer belt $H_{100}$ of the first group $R_I$ into the second group $R_{II}$ of drying cylinders.

Figure 8:
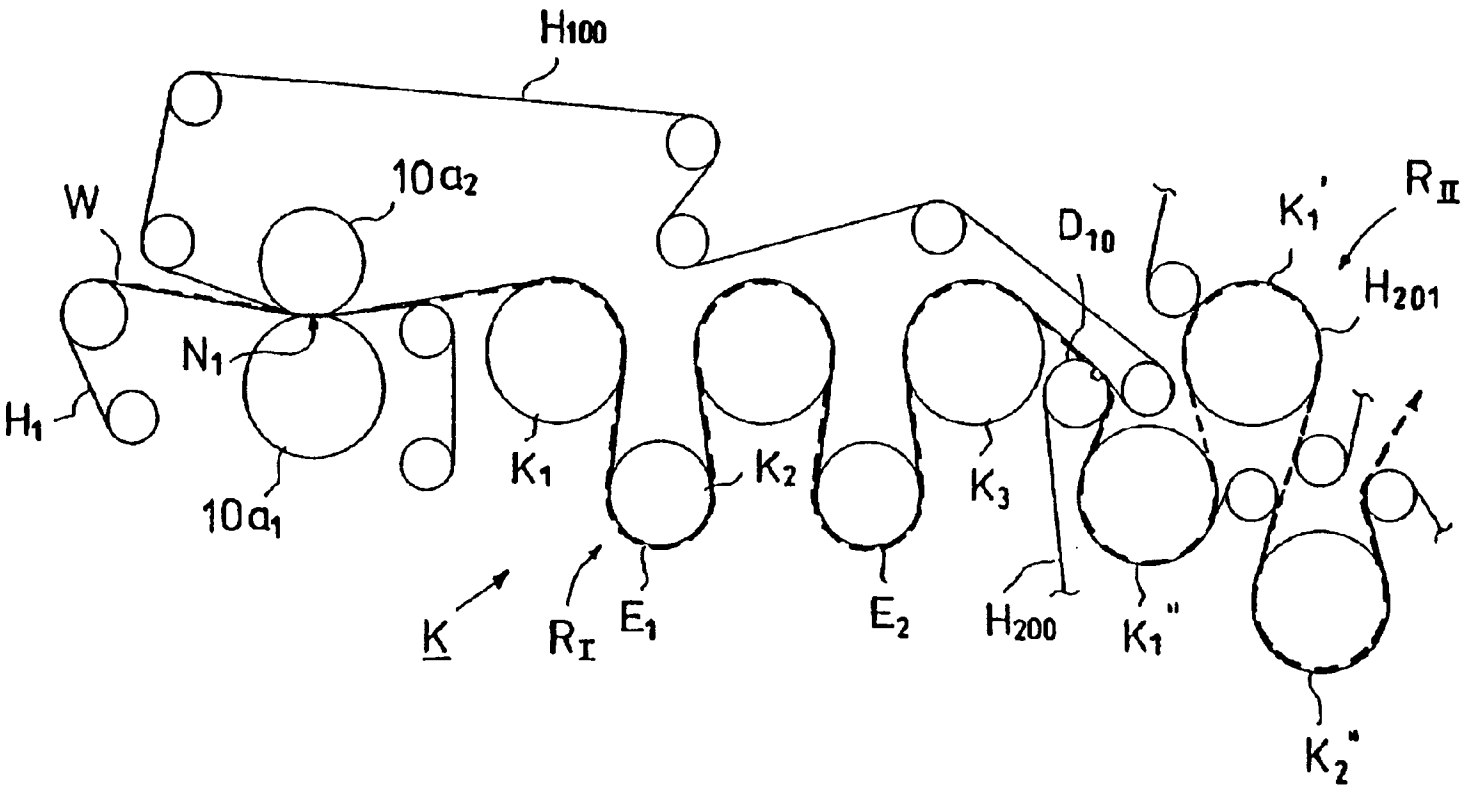
FIG. 8 shows an embodiment of the invention in which the transfer belt of a group of drying cylinders has been fitted to an trough a press nip and in which, in the first group $R_I$ of drying cylinders, the drying cylinders are placed in upper positions and the reversing rolls in lower positions, and in which solution the web is transferred from the first group $R_I$ of drying cylinders into a group $R_{II}$ of drying cylinders provided with twin-wire draw.

FIG. 8 shows an embodiment that is in other respects similar to FIG. 1, but in which embodiment the second group $R_{II}$, of drying cylinders is a conventional group of drying cylinders with twin-wire draw. The group of drying cylinders in FIG. 8 additionally differs from the embodiment shown in FIG. 1 in the respect that, in the embodiment of FIG. 8, the reversing rolls $E_1$,$E_2$ are placed in the lower position in relation to the drying cylinders $K_1$,$K_2$,$K_3$. In the end of the group $R_I$, the web W is picked up from the face of the transfer belt $H_{100}$ by means of a transfer suction roll $D_{10}$, which is placed inside the lower wire loop $H_{200}$ of the second group $R_{II}$ of drying cylinders.

In the embodiments described above in relation to FIGS. 4 . . . 8, it is obvious that, in connection with the reversing rolls $E_1$ placed after the drying cylinders, it is additionally possible to fit impingement drying apparatuses, as is illustrated in FIGS. 3A and 3B.

Figure 9A:
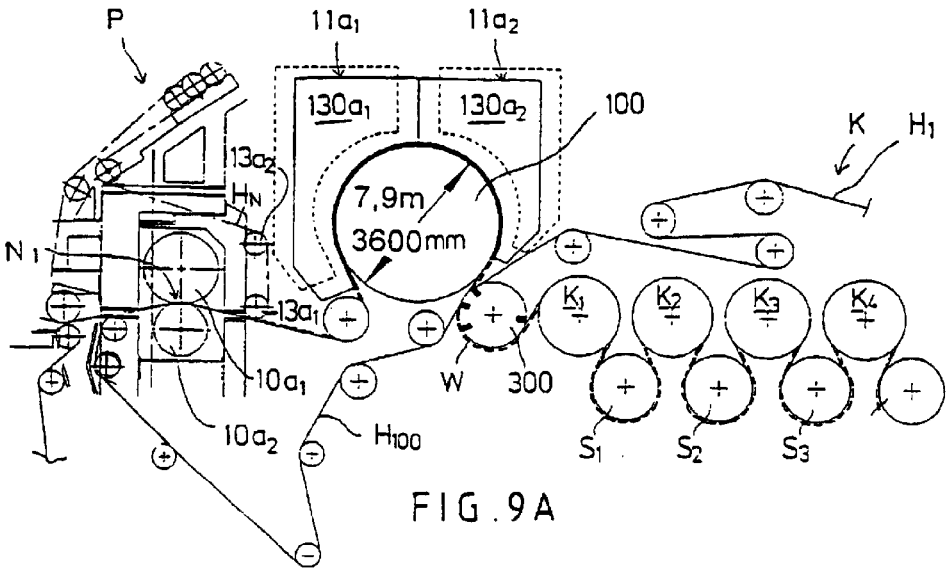
FIG. 9A shows an embodiment of the invention in which the transfer belt is passed from the last press in the press section through a press nip so that, inside the loop of the transfer belt, there is a large-diameter roll, along with whose face two impingement drying units and their impingement hoods have been fitted.

In the solution shown in FIG. 9A, in the last press nip, in the place of the lower felt thee is a transfer belt $H_{100}$ (TransBelt). Normally the web W is separated from the transfer belt $H_{100}$ directly after the press, but in the solution in accordance with the present invention the web is passed over a turning roll or drying cylinder onto an impingement drying roll. Since, after pressing, the web adheres tightly to the face of the transfer belt, the web need not be supported in any way during the impingement drying. After the impingement drying unit the web is transferred onto the first drying cylinder, and the drying is continued normally with single-wire draw.

The turning roll or the drying cylinder 12$a_n$ of the transfer belt $H_{100}$ can be coated if steel, rubber, or flake graphite cast iron causes problems of adhesion. A second possibility is to employ such a high steam pressure in the cylinder that a film of steam is formed between the web and the cylinder, in which case the web does not adhere to the face of the cylinder.

The roll 100 that is provided with impingement drying units 11$a_1$, 11$a_2$ can be a smooth roll in this case. On the roll, impingement drying is applied to the web, in which connection the dry solids content of the web becomes higher before the transfer to the geometry with single-wire draw. The hoods of the impingement drying units are denoted with 130$a_1$,130$a_2$. In them, the discharge faces for the impingement drying medium, such as air, are placed in the vicinity of the web W, while the web W follows the face of the transfer belt $H_{100}$ along with the face of the roll 100.

FIG. 9A shows the use of the transfer belt $H_{100}$ in connection with the last press 10$a_1$,10$a_2$ in the press P, which last press is preferably an extended-nip press, which comprises an extended-nip roll 10$a_1$, which is provided with a resilient belt mantle which adapts itself to the shape of the preferably smooth-faced backup roll 10$a_2$ while the extended-nip roll is provided with a loading shoe connected with its central axle and placed inside the belt mantle, the shape of the loading face of said loading shoe corresponding to the shape of the face of the backup roll.

In accordance with the invention, the transfer belt $H_{100}$, to which the web adheres in the nip $N_1$, is transferred further to the impingement drying units 11$a_1$, and 11$a_2$, which have been fitted in the vicinity of the face of the large-diameter roll 100. In the embodiment shown in FIG. 9A, the diameter of the roll 100 is 3600 mm, in which case the length of the impingement drying zone is 7.9 metres. The whole impingement drying assembly in the embodiment of FIG. 9A consists of two parts and comprises the impingement drying units 11$a_1$ and 11$a_2$. Through each impingement drying unit 11$a_1$, 11$a_2$, a heat transfer medium, such as warm air or steam, is blown into connection with the web W in order to dry the web.

As is shown in the figure, the transfer belt $H_{100}$ is passed over the alignment rolls 12$a_3$,12$a_4$ . . . . The upper felt $H_N$ is also passed through the press nip $N_1$ of the extended-nip press and guided by means of the alignment rolls 13$a_1$,13$a_2$ . . . From the transfer belt $H_{100}$ the web W is transferred over the transfer suction roll 300 into the first drying group $R_I$ in the dryer section K, which group is provided with a conventional run $H_1$ of a drying wire.

The group $R_I$ of drying cylinders in the dryer section K comprises drying cylinders $K_1$,$K_2$ . . . and suction cylinders $S_1$,$S_2$ . . . (of the VacRoll type). The dryer section K is a conventional construction of a dryer section. It comprises preferably several groups of drying cylinders, but it is an essential feature of the whole construction that the transfer belt $H_{100}$ is placed in the construction so that, by its means, the paper or board web W is transferred from the press section P to the dryer section K.

Example of measures for the geometry shown in FIG. 1 (roll diameter 3600 mm):

running speed 2000 metres per minute rate of evaporation 120 kg (per square metre in an hour)

diameter of impingement drying roll 3.6 m (coverage 215 degrees)

increase in dry solids content 45→48.5%.

An increase of 3.5% in the dry solids content means a considerable improvement in the properties of strength of the web, and the transfer of the web from the cylinder further at this dry solids content is already considerably more reliable than at a dry solids content of 45%.

Figure 9B:
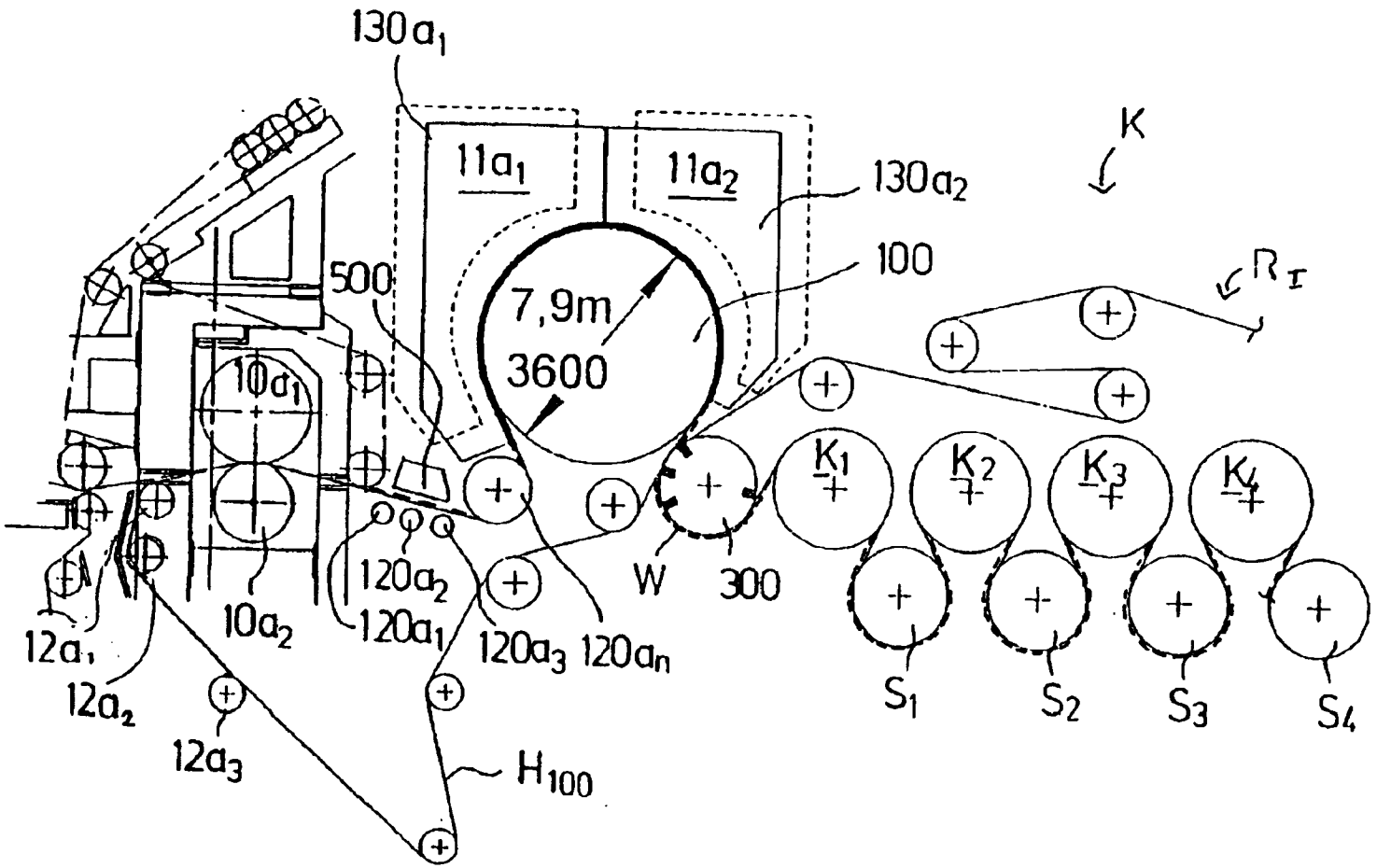
FIG. 9B shows an embodiment of the invention which is in the other respects similar to the embodiment shown in FIG. 9A, but in the embodiment of FIG. 9B, before the what is called impingement drying roll, an impingement drying unit is placed, by whose means pre-heating of the web is carried out before the impingement drying roll proper.

In FIG. 9B, in the geometry in accordance with the invention, it is also possible to use an additional impingement drying unit 500 before the turning roll 12$a_n$, in which case the impingement drying would take place on a plane. This solution would provide the advantage that the temperature of the web can be raised before the impingement drying proper. Depending on the length of the unsupported draw, the transfer belt $H_{100}$ can be supported from below, for example, by means of a sufficient number of support rolls 12O$a_1$,12O$a_2$ . . . .

Figure 10:
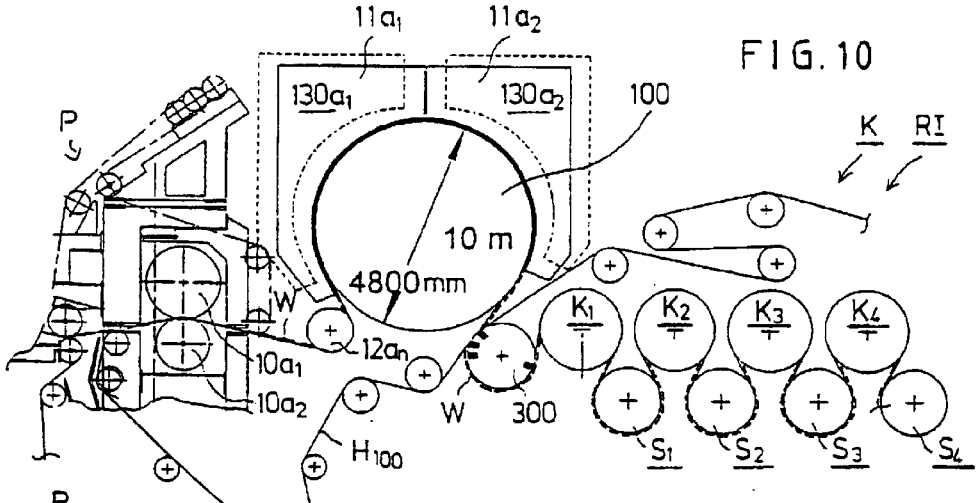
FIG. 10 shows an embodiment that is in the other respects similar to FIG. 9A, but in the embodiment shown in FIG. 10, the what is called impingement drying roll has been substituted for by a roll with an even larger diameter in order to increase the length of the impingement drying zone.

FIG. 10 shows an embodiment in the other respects similar to FIG. 9A, but in the embodiment of FIG. 10 the roll 100 has an even larger diameter of 4800 mm, as compared with that shown in the solution of FIG. 9A. In such a case, the length of the impingement drying zone becomes 10 metres. Correspondingly, the increase in the dry solids content produced by the impingement drying is higher than in the solution shown in FIG. 9A.

Figure 11:
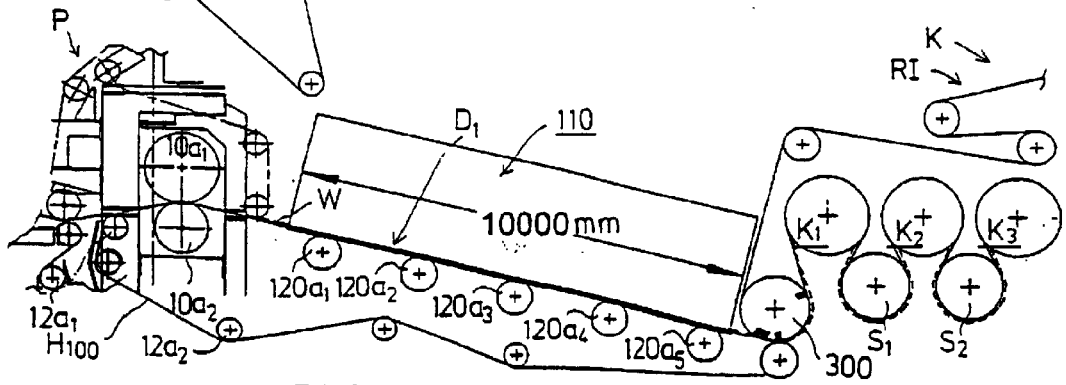
FIG. 11 shows an embodiment of the invention in which the what is called impingement drying roll has been substituted for by an oblong impingement drying hood. The impingement drying unit has been fitted in connection with a linear run of the transfer belt, and after the impingement drying unit the web is transferred from the transfer belt into the first group of drying cylinders in the dryer section.

FIG. 11 shows an embodiment of the invention in which the roll 100 has been substituted for by an oblong impingement drying hood 110 of the impingement drying unit 11$a_1$. The run of the transfer belt $H_{100}$ is in the other respects similar to that in the embodiments shown in FIGS. 9 and 10. In this embodiment, the run of the transfer belt $H_{100}$ comprises a straight linear run portion $D_1$ between the last press in the press section P, which last press is preferably an extended-nip press, and the first drying group $R_I$ in the dryer section K. The support rolls 120$a_1$,120$a_2$,120$a_3$,120$a_4$, 120$a_5$ support the run of the transfer belt $H_{100}$, and the oblong hood 110 of the impingement drying unit has been fitted on the run $D_1$ in the embodiment shown in the figure. The length of the impingement drying zone is about 10 metres. In such a case, a considerable drying capacity is achieved. In the way shown in the figure, by means of the suction roll 300 the web is transferred from the face of the transfer, belt $H_{100}$ onto the face of the drying wire $H_1$ of the first drying group $R_I$ in the dryer section K, and further in the dryer section K.

Figure 12:
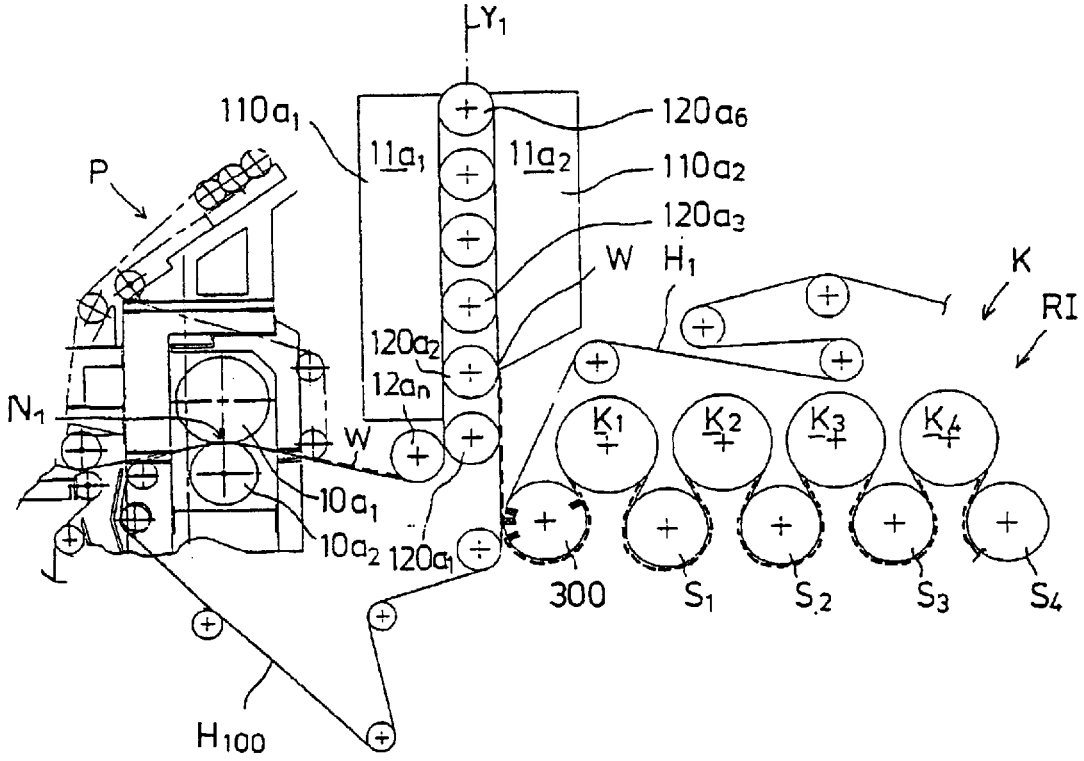
FIG. 12 shows an embodiment in the other respects similar to FIG. 11, but in the solution of FIG. 12 the length of the impingement drying zone has been increased by fitting the support rolls in a vertical stack, in which case the web and the run of the transfer belt run first along with the support rolls upwards and from the last support roll along with the corresponding support rolls downwards. Impingement drying units have been fitted at both sides of the support rolls.

In FIG. 12, an embodiment is shown which is in the other respects similar to FIG. 11, but in the embodiment of FIG. 12 the impingement drying length has been increased by fitting the support rolls 120$a_1$, 120$a_2$ . . . vertically and by fitting impingement drying units 11$a_1$ and 11$a_2$ at both sides of the support rolls 120$a_1$,120$a_2$ . . . .

The support rolls 120$a_1$,120$a_2$ . . . are placed so that their axles are placed in a vertical plane $Y_1$, and the transfer belt $H_{100}$ is passed along the support rolls 120$a_1$, 120$a_2$ . . . first upwards and, around the last support roll in the vertical stack and after said roll downwards along the corresponding support rolls 120$a_1$,120$a_2$ . . . . Thus, at each side of the support rolls 120$a_1$, 120$a_2$ . . . , there are impingement drying units 11$a_1$,11$a_2$, through which warm air, steam or some other heating medium is blown into connection with the web W in order to dry the web. The hoods 110$a_1$,110$a_2$ . . . of the impingement drying units 11$a_1$,11$a_2$ are oblong constructions.

Further, in FIG. 12, a solution is suggested in which the web runs along a linear path by means of a belt upwards (may also take place downwards). It is an advantage of the solution of FIG. 12 that the dryer section becomes considerably shorter in the longitudinal direction. In stead, more space is required in the direction of height.

Figure 13:
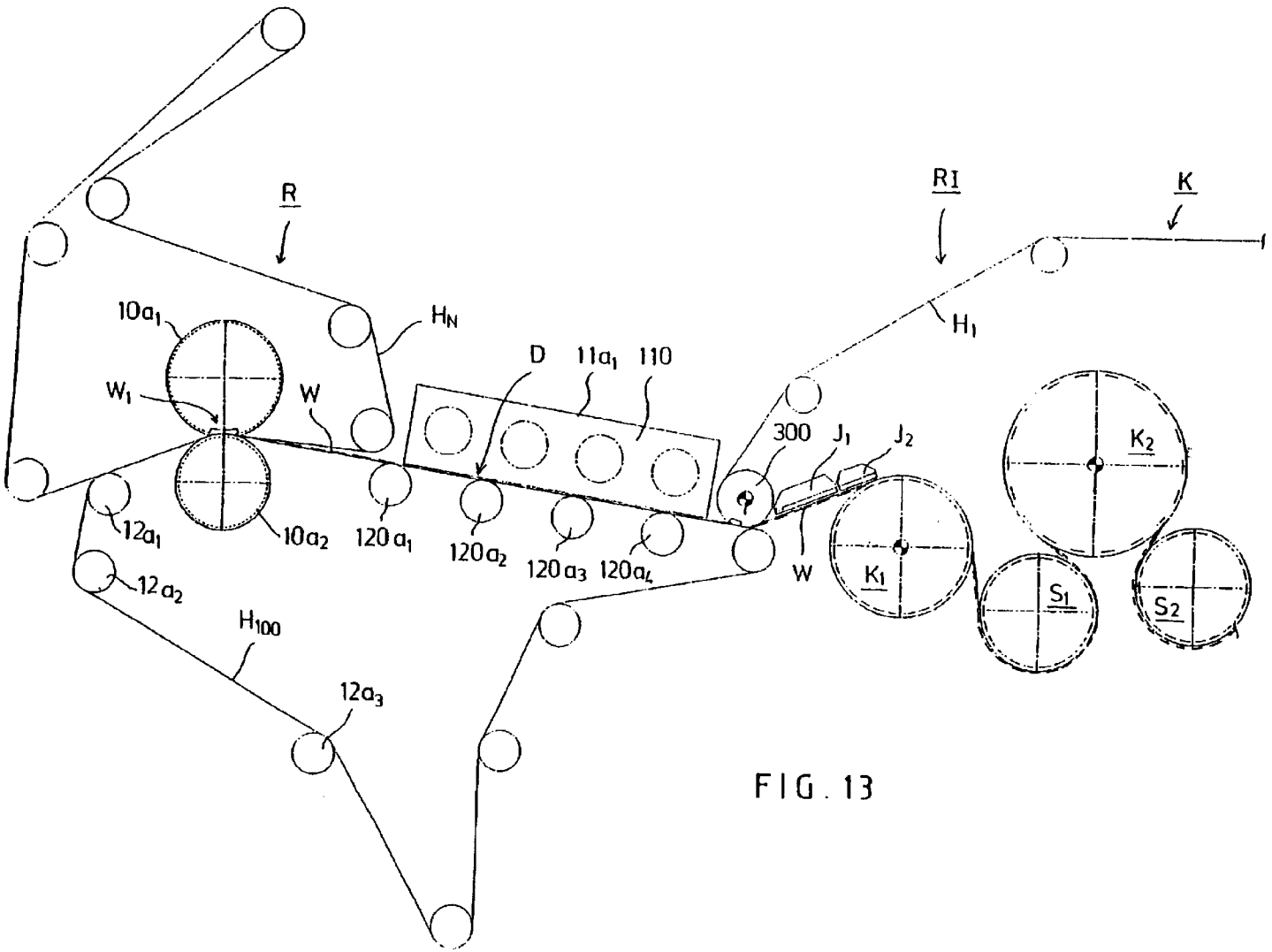
FIG. 13 shows a construction in the other respects similar to FIG. 11, but in this embodiment the beginning of the dryer section K includes suction boxes right after the transfer suction roll.

FIG. 13 shows a construction similar to FIG. 11. The embodiment shown in this figure differs from the embodiment shown in FIG. 1 in respect of the construction of the inlet side of the drying group $R_I$ in the dryer section K. The initial part of the dryer section K comprises suction boxes $J_1$,$J_2$ after the suction cylinder M.

Even if, in FIGS. 11, 12 and 13, linear long transfer belt draws are illustrated, the invention is not confined to such draws alone, but the transfer belt draw may also be curved if such a shape is preferable in view of the machine geometry, the belt tension to be maintained, or the runnability, or in view of an equivalent factor.

What is claimed is:

1. An equipment for transferring a paper/board web in a paper or board machine, said equipment comprising:

a transfer belt structured and arranged for securing a web by means of adhesion;

a roll that forms a press nip in a last press section of said paper or board machine;

wherein said belt is structured and arranged such that said web is passed from said last press further in said paper or board machine while said web is adhered to said belt and wherein said belt is structured and arranged such that a thermal energy is supplied to said web while said web is adhered to said belt;

a plurality of alignment rolls;

a roll having at least one impingement drying unit arranged after said press nip and before said first group of drying cylinders;

a press felt which is passed through said press nip;

wherein said belt passes over said alignment rolls, through said press nip, and over said roll having at least one impingement drying unit and over said first group of drying units while being adhered to said belt.

2. An equipment as claimed in claim 1, further comprising:

a dryer section comprising at least one group of drying cylinders;

a plurality of reversing rolls structured and arranged to cooperate with said drying cylinders;

and wherein said belt is passed over said drying cylinders and said reversing cylinders.

3. An equipment as claimed in claim 2, wherein said dryer section comprising at least one group of drying cylinders includes a first group of drying cylinders; and wherein said belt is structured and arranged as a closed loop in said first group of drying cylinders; and wherein said web is passed on said belt through said last press in said press section into said first group of drying cylinders as a closed web draw supported by said transfer belt.

4. An equipment as claimed in claim 3, wherein said dryer section comprising at least one group of drying cylinders further comprises a second group of drying cylinders arranged after said first group of drying cylinders, second group of drying cylinders comprising:

a conventional wire draw; and a plurality of suction rolls; and wherein said web is transferred into said second group of drying cylinders as a closed draw and wherein said web is passed over said second group of drying cylinders and said plurality of suction rolls on said conventional wire draw; and wherein said web is maintained in contact with said conventional wire draw over said suction roll by means of a pressure produced by said suction rolls.

5. An equipment as claimed in claim 3, wherein said first group of drying cylinders comprises impingement drying units through which a drying medium is passed into the web.

6. An equipment as claimed in claim 2, wherein said reversing rolls are smooth faced rolls and wherein said web runs over said reversing rolls while adhered to said belt.

7. An equipment as claimed in claim 1, wherein said belt is structured and arranged to be impenetrable by air and water.

8. An equipment as claimed in claim 1, further comprising:

a linear run having a plurality of support rolls arranged after said press nip;

an impingement drying unit arranged after said liner run, said impingement drying unit comprising an oblong hood;

a drying section arranged after said impingement drying unit;

wherein said web is passed while being adhered to said belt over said linear run and over said impingement drying unit and then is transferred from said belt into said drying section arranged after said impingement drying unit.

9. An equipment as claimed in claim 1, further comprising:

a plurality of support rolls arranged after said press nip, said plurality of support rolls being structured and arranged so that belt passes over said plurality of support rolls along a vertical path;

a first impingement drying unit arranged along said vertical path;

a second impingement drying unit arranged after said first impingement drying unit and below said vertical path;

wherein said belt is passed over said plurality of support rolls, over said first impingement unit, downwards and over said second impingement unit and into said first group of drying cylidners.

10. An equipment as claimed in claim 1, wherein said last press nip is a equalizing press with no felt.

11. An equipment for transferring a paper/board web in a paper or board machine, said equipment comprising:

a transfer belt structured and arranged for securing a web by means of adhesion;

a roll that forms a press nip in a last press section of said paper or board machine;

wherein said belt is structured and arranged such that said web is passed from said last press further in said paper or board machine while said web is adhered to said belt and wherein said belt is structured and arranged such that a thermal energy is supplied to said web while said web is adhered to said belt;

a dryer section comprising at least one group of drying cylinders;

a plurality of reversing rolls structured and arranged to cooperate with said drying cylinders;

wherein said belt is passed over said drying cylinders and said reversing cylinders;

wherein said dryer section comprising at least one group of drying cylinders includes a first group of drying cylinders; and wherein said belt is structured and arranged as a closed loop in said first group of drying cylinders; and wherein said web is passed on said belt through said last press in said press section into said first group of drying cylinders as a closed web draw supported by said transfer belt;

a plurality of alignment rolls;

a roll having at least one impingement drying unit arranged after said press nip and before said first group of drying cylinders;

a press felt which is passed through said press nip;

wherein said belt passes over said alignment rolls, through said press nip, and over said roll having at least one impingement drying unit and over said first group of drying units while being adhered to said belt.

12. A method in the transfer of a web in a paper or board machine comprising the steps:

passing the web on a face of a transfer belt, wherein said web is secured to said transfer belt by means of adhesion;

passing said belt over a last press of a press section in said paper or board machine so that said transfer belt is in contact with a press roll of said last press;

passing said web from said last press in said press section alone with said transfer belt over a linear run arranged after said last press, said linear run including a plurality of support rolls;

passing said web and said transfer belt over an impingement drying unit arranged after said liner run, said impingement drying unit having hood through which a drying medium is passed in order to dry the web; and after said impingement drying unit passing said web from said transfer belt into a first group of drying cylinders of a drying section of said paper or board machine.

13. A method as claimed in claim 12, further comprising:

passing said web over a first drying cylinder in a first group of drying cylinders in a dryer section of said paper or board machine while said web is adhered to said belt;

passing said web over a reversing roll arranged after said first dying cylinder while said web is adhered to said belt;

passing said web over a second drying roll arranged afer said reversing roll in said group of drying cylinders.

14. A method as claimed in claim 13, wherein:

said belt has been passed as a closed draw over said press nip, said first drying cylinder, said reversing roll and said second drying roll.

15. A method as claimed in claim 12, further comprising:

passing said belt over an impingement drying unit arranged in connection with a reversing roll.

16. A method as claimed in claim 15, wherein said web is transferred in said first group of drying cylinders as a closed loop over said drying cylinders, and wherein said drying cylinders are steam-heated drying cylinders, and wherein said press nip is an extended-nip press.

17. A method as claimed in claim 13, wherein said reversing rolls are suction rolls, said suction rolls having a smooth face, and further comprising:

passing said web from said first group of drying cylinders to a conventional group of drying cylinders provided with a single wire draw;

passing said web over a first drying cylinder in said conventional group of drying cylinders;

passing said web from said first drying cylinder over a first suction roll;

passing said web from said first suction roll over a second drying cylinder in said conventional group of drying cylinders;

passing said web a plurality of alternating suction rolls and drying rolls, wherein said suction rolls are used as reversing rolls.

18. A method as claimed in claim 12, wherein said transfer belt is passed through said last press nip as a closed loop, further comprising:

passing said transfer belt and web over a roll having a large diameter, said roll having a large diameter including at least one impingement drying unit through which a drying medium is passed to dried said web;

passing said web from said roll having a large diameter to a first drying group in a dryer section of said paper or board machine.

19. A method in the transfer of a web in a paper or board machine comprising the steps:

passing the web on a face of a transfer belt, wherein said web is secured to said transfer belt by means of adhesion;

passing said belt over a last press of a press section in said paper or board machine so that said transfer belt is in contact with a press roll of said last press;

passing said web from said last press in said press section along with said transfer belt over a linear run arranged after said last press, said linear run including a plurality of support rolls;

passing said web and said transfer belt over an impingement drying unit arranged after said liner run, said impingement drying unit having hood through which a drying medium is passed in order to dry the web; and after said impingement drying unit passing said web from said transfer belt into a first group of drying cylinders of a drying section of said paper or board machine.

20. A method in the transfer of a web in a paper or board machine comprising the steps:

passing the web on a face of a transfer belt, wherein said web is secured to said transfer belt by means of adhesion;

passing said belt over a last press of a press section in said paper or board machine so that said transfer belt is in contact with a press roll of said last press passing said web along with said transfer belt from said last press over a plurality of support rolls that run in a vertical path;

passing said web and said transfer belt over a first impingement drying unit arranged in said vertical path;

passing said web along with said transfer belt over a last one of said plurality of support rolls in said vertical path over a plurality of support rolls in a downward path;

passing said web along with said transfer belt over a second impingement drying unit arranged in said downward path; and passing said web after said second impingement drying unit from said belt into a first group of drying cylinder of a dryer section of said paper or board machine.

* * * * *